US009976387B2

(12) United States Patent
Bisset

(10) Patent No.: US 9,976,387 B2
(45) Date of Patent: May 22, 2018

(54) SELECTIVELY OPERATED TWO WAY CHECK VALVE FOR SUBTERRANEAN USE

(71) Applicant: Baker Hughes Incorporated, Houston, TX (US)

(72) Inventor: Stephen Bisset, Kingwood, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 858 days.

(21) Appl. No.: 14/265,021

(22) Filed: Apr. 29, 2014

(65) Prior Publication Data

US 2015/0308225 A1 Oct. 29, 2015

(51) Int. Cl.

| | |
|---|---|
| ***E21B 34/10*** | (2006.01) |
| ***E21B 34/06*** | (2006.01) |
| ***E21B 33/127*** | (2006.01) |
| ***E21B 34/08*** | (2006.01) |
| ***E21B 21/10*** | (2006.01) |

(52) U.S. Cl.

CPC ..... *E21B 34/102* (2013.01); *E21B 21/10* (2013.01); *E21B 33/127* (2013.01); *E21B 34/06* (2013.01); *E21B 34/063* (2013.01); *E21B 34/08* (2013.01); *E21B 34/10* (2013.01)

(58) Field of Classification Search

CPC ..... E21B 34/06; E21B 34/063; E21B 34/08; E21B 34/10; E21B 34/102

See application file for complete search history.

(56) References Cited

U.S. PATENT DOCUMENTS

| | | | | |
|---|---|---|---|---|
| 3,001,585 | A * | 9/1961 | Shiplet | E21B 33/146 166/142 |
| 4,628,996 | A | 12/1986 | Arnold | |
| 5,320,181 | A * | 6/1994 | Lantier, Sr. | E21B 21/10 166/325 |
| 5,547,029 | A | 8/1996 | Rubbo et al. | |
| 6,659,184 | B1 | 12/2003 | Tips et al. | |
| 7,509,969 | B2 * | 3/2009 | Huang | F16K 15/026 137/226 |
| 7,658,229 | B2 | 2/2010 | Becker et al. | |
| 8,037,940 | B2 * | 10/2011 | Patel | E21B 23/03 166/167 |
| 2012/0222861 | A1 | 9/2012 | Eriksen | |
| 2013/0153239 | A1 * | 6/2013 | McIntosh | E21B 21/106 166/321 |
| 2013/0255952 | A1 | 10/2013 | Hailey, Jr. et al. | |

* cited by examiner

*Primary Examiner* — David J Bagnell
*Assistant Examiner* — Tara E Schimpf
(74) *Attorney, Agent, or Firm* — Steve Rosenblatt

(57) ABSTRACT

A selectively two directional check valve is located on a string with a packer and is either held open for running in so that the string can fill and doesn't become buoyant or includes a closable ported sub to allow string filling for running in that can then be closed. Pressure is applied from the surface to drive an object down to a seat so that a packer can be set. Further pressure increase shifts the object and the seat and locks the seat in the shifted position. A spring return force pushes the object to an upper seat to prevent uphole flow. Flow in the downhole direction is possible by overcoming the spring bias to move the object off the upper seat while preventing the object from moving down far enough to engage the shifted lower seat. Flow downhole just goes around the object.

14 Claims, 2 Drawing Sheets

SELECTIVELY OPERATED TWO WAY CHECK VALVE FOR SUBTERRANEAN USE

FIELD OF THE INVENTION

The field of the invention is a two way check valve and more particularly where there are features to convert the operation to one way operation after actuating a subterranean tool so that other operations can then take place.

BACKGROUND OF THE INVENTION

Check valves are used in a variety of applications to limit flow in one direction while allowing flow in an opposite direction. Typically two way check valves are used to prevent flow in opposed directions when actuated but having been actuated they remain closed to flow in both directions. Some examples of these types of valves are: US2012/0222861 and U.S. Pat. No. 4,628,996 (FIGS. 11 and 12). Other designs just cut off flow in multiple directions when there is a line break such as U.S. Pat. No. 5,547,029. Some designs use redundant check valves in parallel that interact such as U.S. Pat. No. 6,659,184 FIG. 2. Yet other designs are mainly one way check valves but mention in passing that they could be configured as two way check valves without describing how that would be usefully accomplished in the context of their disclosure such as US2013/0255952. Yet other designs are multidirectional valves that redirect flow in various flow regimes and are not necessarily check valves at all such as U.S. Pat. No. 7,658,229.

In some applications there is a need to build pressure in a downhole direction such as for setting a packer and then having set the packer to convert to a unidirectional check valve operation where flow is permitted in the downhole direction but prevented in the uphole direction. In a specific application, a heavy oil that needs to be diluted so that it can be pumped to the surface with an electric submersible pump (ESP) requires the ability to pump down the diluent in a downhole direction while providing a safety device that will prevent flow backing up the diluent delivery line should the formation experience a pressure buildup. At the same time a packer needs to be set to isolate the heavy oil from the remainder of the borehole so that mixing with the diluent can happen below the packer. The present invention address this specific situation and is suitable for other applications where for a time single direction checking of flow is desired such as to set a packer and at other times flow is enabled in a direction previously checked to accomplish another downhole objective such as fluid dilution of a heavy oil so it can be pumped to the surface with an ESP. These and other aspects of the present invention will be more readily apparent to those skilled in the art from a review of the description of the preferred embodiment and the associated drawings while recognizing that the full scope of the invention is to be determined by the appended claims.

SUMMARY OF THE INVENTION

A selectively two directional check valve is located on a string with a packer and is either held open for running in so that the string can fill and doesn't become buoyant or includes a closable ported sub to allow string filling for running in that can then be closed. Pressure is applied from the surface to drive an object down to a seat so that a packer can be set. Further pressure increase shifts the object and the seat and locks the seat in the shifted position. A spring return force pushes the object to an upper seat to prevent uphole flow. Flow in the downhole direction is possible by overcoming the spring bias to move the object off the upper seat while preventing the object from moving down far enough to engage the shifted lower seat. Flow downhole just goes around the object.

BRIEF DESCRIPTION OF THE DRAWINGS

FIG. 2 is the valve of FIG. 1 showing one way to allow tubular filling during running in.

DETAILED DESCRIPTION OF THE PREFERRED EMBODIMENT

Figure 1:
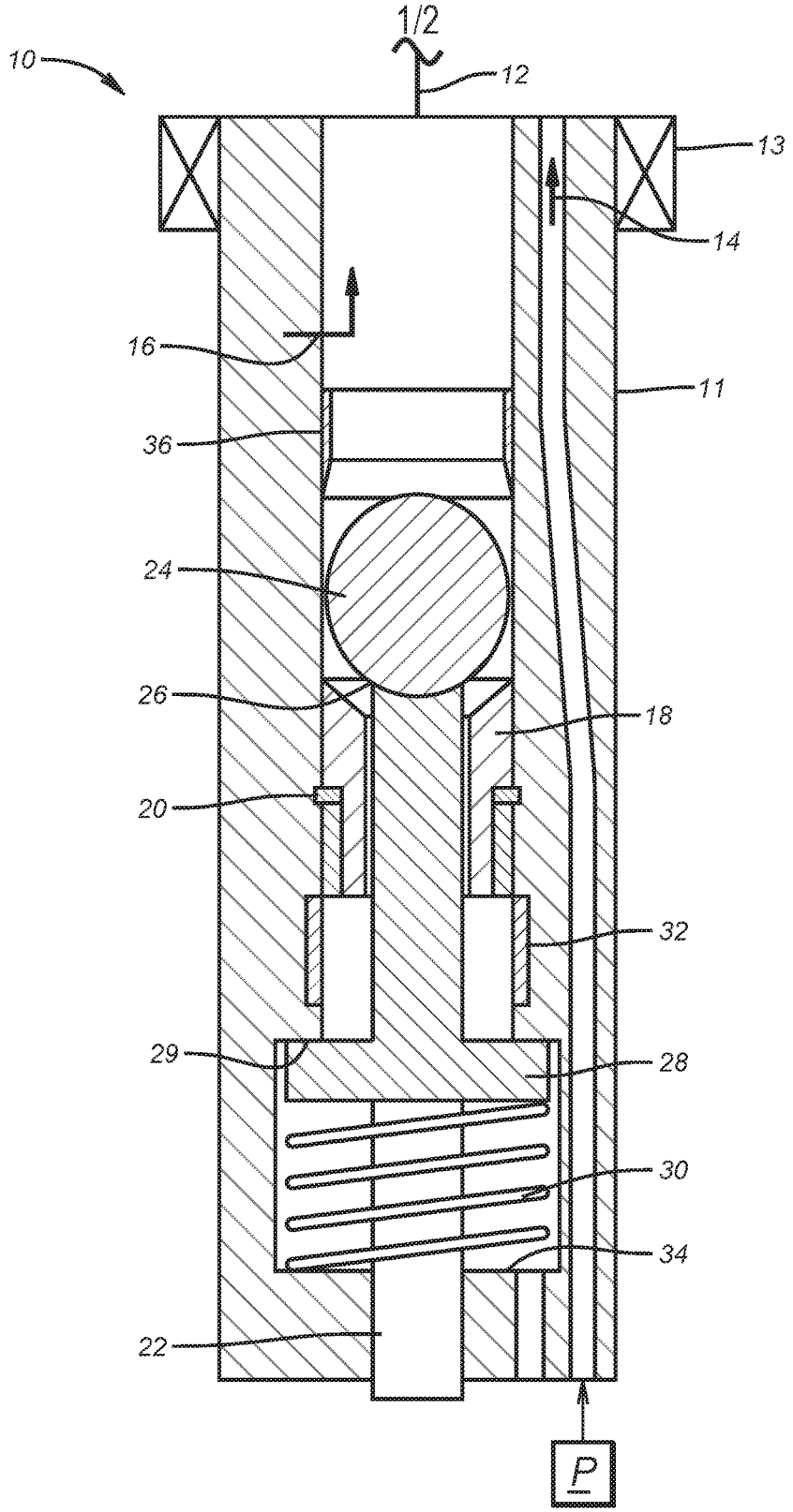
FIG. 1 is a schematic view of the selective two way check valve.

FIG. 1 schematically illustrates a dual bore packer 10 comprising a housing 11 supported by a tubular string 12. In the envisioned preferred application there is low pressure heavy oil in the well that needs to be pumped to the surface preferably with electric submersible pump P. Such pumped flow needs to get past the packer 13 as represented by arrow 14 so that such flow can reach the surface in an upper annulus that exists around the tubular string 12. There are several objectives. One is to be able to fill the string 12 when running the string in so that it does not become buoyant. One way this is done is to install a flow or pressure sensitive ported sub that is schematically illustrated by arrow 16. This sub is run in open to allow the string 12 to fill. An increase in flow or raising the pressure with more flow gets the sub to close and stay closed. Such devices are known in the art for the purpose of allowing strings to fill when running in. A lower seat 18 is held in place with a breakable member such as a shear ring 20. A plunger shaft 22 extends through lower seat 18 and has an object 24 secured preferably at an end 26. The shape of the object 26 is complementary to the seat 18 shape so that when the two are in contact pressure can be contained against the object 24. To get the object 24 onto the seat 18 flow is increased to drive piston 28 against the bias of spring 30. It should be noted that piston 28 allows flow to bypass as it has no peripheral seals but with enough flow the force of the spring 30 will be overcome and the object 24 will land on lower seat 18 to allow pressure to build up to set the packer 13. After the packer sets the pressure is further increased to break the breakable member 20 to thus shift the object 24 and its seat 18 in tandem in a downhole direction to a second position until the locking member 32 is engaged. With the seat 18 lowered that far and locked the piston 28 can no longer travel down far enough to let the object 24 still land on the seat 18 because the spring 30 supported off open support 34 prevents sufficient downward movement of the plunger shaft 22 to allow the object 24 to reach the now relocated seat 18. On the other hand flow in the reverse direction is prevented as spring 30 pushes piston 28 against shoulder 29 that acts as a travel stop and with it the object 24 upwardly until the object 24 runs into top seat 36 carried by the flow past piston 28. When object 24 is on seat 36 there is no flow possible toward the string 12.

Figure 2:
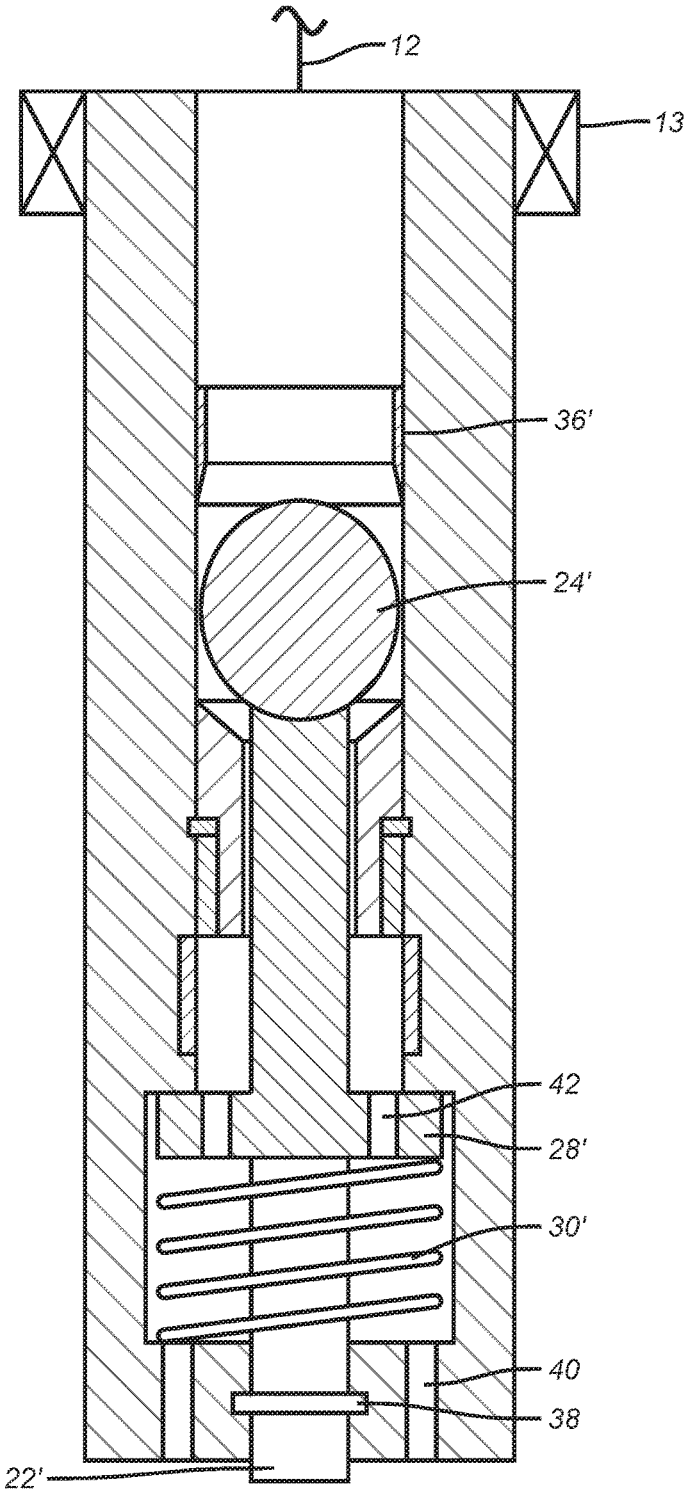

FIG. 2 differs from FIG. 1 in the manner the string is allowed to fill when running in. In other respects the operation of the FIG. 2 design is the same as FIG. 1. The difference is that the device 16 of FIG. 1 that lets flow into the string 12 when running in is replaced with a breakable restraint 38 that holds the object 24' away from seat 36' and against the force of the bias from spring 30'. When that happens flow is possible into the string 12' as it is being lowered. Such flow can go through passages 40 and 42 to get past seat 36' that is open because the object 24' is held back from reaching seat 36'. When the string 12' is run into the desired location the flow is increased to put a force on the piston 28' that will shear the restraint 38. At this point the operation of FIG. 2 is the same as FIG. 1.

In the intended application the device first allows string 12 to fill as it is positioned at the desired location for setting the packer 13. The packer 13 is allowed to set because pressure from the surface is contained and directed to the packer 13 until it sets. After setting the packer 13 further pressure increase breaks shear restraint 20 and locks the lower seat in a shifted position that precludes the object 24 from landing on the seat 18. This allows fluid to be delivered through the string 12 past the packer 13 to mix with the heavy oil that then is pumped with the ESP or other type of pump P through the packer 13 in a parallel passage represented by arrow 14 so that the blended flow reaches an outer annulus around the string 12 in the zone above the packer 13. In the unlikely event of a pressure surge in the reservoir, flow toward the string 12 is blocked as the object 24 with the aid of the spring 30 is pushed to the point of seating off on seat 36 to block flow in the uphole direction.

While spring 30 is shown as a coiled spring other types of springs like a Belleville washer stack or compressible gas can also be used. The permitted flow directions can also be changed in the invention while retaining the feature of selective checking flow in at least one direction for one operation while later allowing such a flow for accomplishing discrete purposes.

The above description is illustrative of the preferred embodiment and many modifications may be made by those skilled in the art without departing from the invention whose scope is to be determined from the literal and equivalent scope of the claims below:

I claim:

1. A multidirectional check valve for mounting in a tubular string extending to a subterranean location, comprising:

a valve member in a housing selectively movable for contact in opposed directions while under force of bias of a first and second valve seats, said first and second valve seats being initially spaced at a predetermined distance, said second valve seat selectively moveable to increase said predetermined distance and to lock said second valve seat after moving to increase said predetermined distance such that said housing limits movement of said valve member from contact with said second valve seat during flow through said housing in a direction through said first and then said second valve seat.

2. The valve of claim 1, wherein:

said valve seats face each other.

3. The valve of claim 1, wherein:

said housing has a selectively open port to allow flow into said housing as the tubular string is extended toward the subterranean location.

4. The valve of claim 1, wherein:

said valve member is selectively retained away from said seats to allow flow into said housing as the tubular string is extended toward the subterranean location.

5. The valve of claim 1, wherein:

said first valve seat is located uphole from said second seat in said housing;

said bias on said valve member is toward said first valve seat.

6. The valve of claim 5, wherein:

said valve member is responsive to flow in said housing to move into contact with said second seat.

7. The valve of claim 6, wherein:

said valve member cutting off flow through said housing to allow pressure to build in said housing when seated against said second valve seat.

8. The valve of claim 7, wherein:

pressure in said housing to a first level, with said valve member in contact with said second seat, sets a packer, on said housing which is mounted to the tubular string, against a surrounding borehole wall;

pressure in said housing at a second level higher than said first level forces said second valve seat to move.

9. The valve of claim 8, wherein:

pressure in said housing to said second level breaks a breakable member to allow said second valve seat to move.

10. The valve of claim 1, wherein:

said housing comprises a travel stop in a direction of movement toward said second valve seat.

11. The valve of claim 10, wherein:

said valve member is initially retained in said housing away from said first valve seat.

12. The valve of claim 10, wherein:

said housing comprises a selectively open port to allow fluid into said housing to reach the tubular string with said valve member under said bias in contact with said first valve seat to allow the tubular string to take liquid as the tubular string is extended to the subterranean location.

13. The valve of claim 8, wherein:

said housing has multiple passages to allow fluid addition to the subterranean location in a first said passage to assist a pump to deliver fluid from the subterranean location in a second said passage.

14. The valve of claim 13, wherein:

said valve member when against said first valve seat preventing fluid from passing into the tubing string.

* * * * *